United States Patent [19]

Cornell

[11] Patent Number: 4,536,026

[45] Date of Patent: Aug. 20, 1985

[54] FOLDING CHAIR

[75] Inventor: Howell N. Cornell, Miami, Fla.

[73] Assignee: Keller Industries, Inc., Miami, Fla.

[21] Appl. No.: 522,503

[22] Filed: Aug. 12, 1983

[51] Int. Cl.[3] ..... A47C 4/00

[52] U.S. Cl. ..... 297/39; 297/46

[58] Field of Search ..... 297/39, 16, 55, 46

[56] References Cited

U.S. PATENT DOCUMENTS

| | | | |
|---|---|---|---|
| D. 268,314 | 3/1983 | Smith | D6/191 |
| 2,233,749 | 3/1941 | Salomon | 297/55 |
| 2,694,442 | 11/1954 | Nordmark | 155/142 |
| 2,957,516 | 10/1960 | Kubisz | 297/46 |
| 3,059,963 | 10/1962 | Hamilton et al. | 297/5 |
| 3,084,979 | 4/1963 | Moore | 297/445 |
| 3,114,572 | 12/1963 | Hopkins | 297/33 |
| 3,279,734 | 10/1966 | Kramer | 297/39 |
| 3,316,013 | 4/1967 | Abel et al. | 297/16 |
| 3,659,898 | 5/1972 | Yellin | 297/445 |
| 3,836,194 | 9/1974 | Milette et al. | 297/55 |
| 4,130,316 | 12/1978 | Rossi | 297/46 |
| 4,470,630 | 9/1984 | Shields | 297/39 |

FOREIGN PATENT DOCUMENTS

| | | | |
|---|---|---|---|
| 2031611 | 12/1971 | Fed. Rep. of Germany | 297/39 |

*Primary Examiner*—Francis K. Zugel

*Attorney, Agent, or Firm*—Steele, Gould & Fried

[57] ABSTRACT

A foldable chair of the lawn chair type has ground-engaging front and rear legs, attached to and carrying a back frame and seat frame, the back frame and seat frame being pivotally attached to a spreader rod which extends beyond the back and seat frames to bear against one of the leg members when the chair is unfolded. A contact pad mounted on the extending portion of the spreader rod is formed as an externally-contoured bushing fit over the spreader rod and adapted to engage the leg member to restrict side-to-side movement of the spreader rod, with respect to the leg member, when the chair is unfolded.

9 Claims, 6 Drawing Figures

FOLDING CHAIR

BACKGROUND OF THE INVENTION

1. Field of the Invention

This invention relates to the field of foldable furniture, and in particular to foldable chairs having tubular frames and webbed support surfaces, commonly called lawn furniture or patio furniture.

2. Description of the Prior Art

The typical foldable patio chair as known in the art generally includes a back frame and a seat frame, both made of tubes bent in the shape of "U" members, pivotally attached to one another at a horizontal rod. When the chair is folded, the back and seat frames are pivoted toward one another; when the chair is opened, the back and seat frames are generally perpendicular to one another. The back frame and seat frame are carried on pairs of ground-engaging front legs and rear legs. The legs are often also made from tubes bent into a "U" and are pivotally attached to the back frame and seat frame at the frames and/or at armrests which are in turn pivotally attached to the frames. The leg members may be single legs, may be connected by cross-members, or may be formed in "U" shapes. The frames and legs are usually sheet metal tubing, for example, aluminum.

Patio chair constructions according to the foregoing general description are shown in U.S. Pat. Nos. 3,084-979-Moore; 3,316,013-Abel, et al.; and, 3,659,898-Yellin. In each of these examples, the rear leg member, that is, the "U" shaped leg member disposed under the back frame, is inclined forwards and used to support the chair when unfolded. A horizontal rod known as a spreader rod functions as a hinge pin in the pivotal attachment of the back frame and seat frame, and extends outwards beyond the back and seat frames, to rest on the rear leg member. When a user sits on the chair, the user's weight urges the spreader rod against the rear leg. The spreader rod and/or the seat and back frames are prevented from sliding down the tilting rear leg by means of a short linkage provided to pivotally connect the rear leg and rod or frames. This linkage is known as a "swing strap," and together with the other pivoting connections, makes the chair structure stable by virtue of the user's own weight.

The stability of folding lawn chairs is directly related to the urging of the spreader rod against the inclined rear leg. In folding and unfolding the chair, and in the various natural movements of users seated in the chair, the spreader rod is caused to slide over the contact point at the rear leg. The spreader rod, normally a solid metal bar, slowly but surely weakens the tubular aluminum rear leg member at the point of contact. Moreover, the leg members are normally constructed as "U" members, such that any axial movement of the spreader bar with respect to the rear leg (i.e., side to side movement) in fact flexes the entire chair, causing metal fatigue at the bends of the "U" members forming the legs.

According to the prior art such as the aforesaid patent to Moore, it is known to place a bushing over the extending portion of the spreader rod. Such a bushing increases the diameter of the spreader rod, spreading its force over a larger area of the rear leg. The bushing decreases damage to the leg due to abrasion because the bushing rolls rather than slides against the leg. Unfortunately, such a bushing fails to address the flexing caused by axial movement of the spreader bar over the rear leg, and the instability associated therewith.

U.S. Pat. No. 2,957,516-Kubisz discloses an appendage for the swing strap, that is, the linkage which pivotally connects the spreader bar and the rear leg. The appendage is a semi-circular sheet metal tab which engages the back of the rear leg when the chair is unfolded. Such a construction, although an improvement over devices which rest the spreader bar directly on the rear leg, relies upon the relatively weak sheet metal swing strap and its sheet metal appendage for basic structural support. The balance of the Kubisz chair is constructed of tubular sheet metal and solid bars. Therefore, the simple sheet metal swing strap, and the sheet metal appendage thereof, may be expected to suffer metal fatigue due to various flexings as the user naturally fidgets and moves about while seated in the chair. Kubisz's swing strap and appendage engaging the rear leg are likely to be the weakest links in the structural support.

U.S. Design U.S. Pat. No. Des. 268,314-Smith discloses a device which appears to be a swing strap in accordance with the Kubisz disclosure, but apparently places the opening for the spreader bar directly behind the semi-circular leg-engaging attachment. It is therefore unclear in Smith whether the semi-circular attachment or the protruding end of the spreader rod is in fact the load-bearing element. In the event that the semi-circular attachment is sufficiently rigid to bear the user's weight, the device is functionally identical to that of Kubisz. Therefore, Smith's swing strap would suffer from the same drawbacks in that structural support depends upon a relatively weak sheet metal member. Due to various axial and transverse movements of the spreader rod caused by a user's movements in the chair, the swing strap will suffer metal fatigue and eventually break. On the other hand, if Smith's semi-circular attachment is made resilient such that the spreader rod bears against the attachment, the spreader rod will slowly wear down the semi-circular attachment. Moreover, axial movement of the spreader rod and the resulting flexing will weaken the overall structure. In this event, the Smith device is functionally the same as the chairs of Moore, Yellin, and Abel, et al., in that the spreader bar will eventually damage the legs, and especially the contact point on the rear leg.

The present invention takes a different approach in that a leg-engaging contact pad in the form of a block is mounted directly on the extending end of the spreader rod. The contact pad, externally concave to complement the shape of the rear leg, not only cushions the spreader rod bearing against the rear leg, but also restricts the spreader rod from any axial movement with respect to the rear leg, that is, side to side with respect to the chair itself. Therefore, without relying upon any relatively weak single sheet metal structures, the device of the invention prevents damage to the rear leg by the spreader bar, and also restricts the chair from any side-to-side flexing which would eventually cause metal fatigue in the bends and joints of the legs.

The contact pad of the invention is constructed in a symmetrical fashion by which it fits equally well on either a left side or right side of the chair. Although the spreader rod fits axially through the contact pad, a transverse slot is provided such that a swing strap connecting the rear leg and the spreader rod can be suitably engaged and protected from flex. In an alternative embodiment, the contact pad further has a contoured end face which engages a further swing strap connecting the seat frame and back frame, thereby providing a resilient and protective connection at the most crucial junction of the folding chair.

SUMMARY OF THE INVENTION

It is an object of this invention to prolong the life and improve the stability of light-weight tubular folding chairs.

It is also an object of the invention to combine a cushion between facing load-bearing surfaces in a tubular folding chair with means for restricting transverse movements destructively causing the chair to flex.

It is another object of the invention to improve the structural integrity and longevity of tubular folding chairs at a minimum of expense and at maximum convenience.

It is yet another object of the invention to provide the most secure and least frictional pivoting connection in a folding chair possible, at the least possible expense.

These and other objects are accomplished by a foldable chair of the type having ground-engaging front and rear legs, attached to and carrying a back frame and seat frame, the back frame and seat frame being pivotally attached to a spreader rod which extends beyond the back and seat frames to bear against one of the leg members when the chair is unfolded. A contact pad mounted on the extending portion of the spreader rod is formed as an externally-contoured bushing fit over the spreader rod and adapted to engage the leg member to restrict side-to-side movement of the spreader rod, with respect to the leg member, when the chair is unfolded.

BRIEF DESCRIPTION OF THE DRAWINGS

There are shown in the drawings the embodiments which are presently preferred. It should be understood, however, that the invention is not limited to the precise arrangements and instrumentalities shown in the drawings, wherein.

DETAILED DESCRIPTION OF THE PREFERRED EMBODIMENTS

Figure 1:
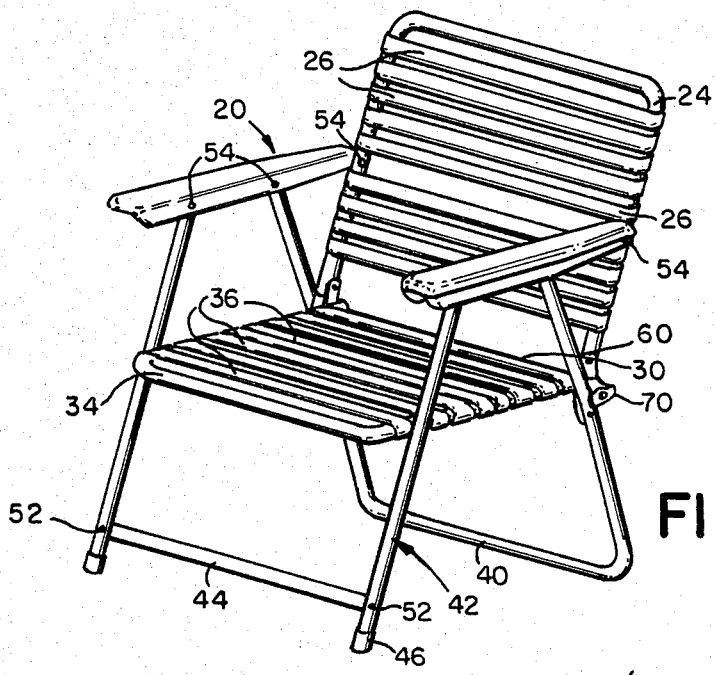
FIG. 1 is a perspective view of a foldable chair according to the invention.

As shown in FIG. 1, a foldable chair 20 according to the invention comprises a back frame 24 and a seat frame 34, pivotally attached to one another for folding the chair. Back frame 24 and seat frame 34 are generally "U"-shaped tubular sheet metal bodies, having a resilient material stretched across the openings defined by the "U". Back webs 26 and seat webs 36 stretch across the openings, and support the user on a resilient support area. Back webs 26 and seat webs 36, or either of them, can also take the form of a continuous fabric sheet, or a woven webbing arrangement.

The back frame 24 and seat frame 34 are, of course, supported by the chair legs 40, 42. As shown in FIG. 1, rear leg member 40 is an upwardly-directed tubular "U"-shaped body, inclined somewhat forwards. Front leg member 42 includes a pair of individual legs 46, rigidly attached by a spacer member 44, by means of rivets 52. The remaining attachments between the respective members including the back and seat frames, the front and rear legs, and the armrests 48 are accomplished by means of pivot pins 54, whereby the chair can be collapsed for storage or transport.

A horizontally disposed spreader rod 30 extends across the chair at the pivoting junction between back frame 24 and seat frame 34, functioning as a hinge pin between frames 24 and 34. The back frame and seat frame are disposed between the upwards-extending portions of rear leg member 40, spreader rod 30 extending outwards beyond frames 24 and 34, and over the rear leg member. A user sitting in the chair exerts a downward force due to gravity on back frame 24 and seat frame 34, urging the extending portions of spreader rod 30 against rear leg member 40. Spreader rod 40 is prevented from sliding down the inclined surface of rear leg member 40 by swing straps, that is, short pivotal linkage members, pivotally connecting spreader rod 30 and inclined leg member 40. Contact pad 70, mounted on the extending portion of spreader rod 30, engages the inclined portion of tubular rear leg 40, preventing wear and damage caused by relative movement between spreader rod 30 and leg 40. Damage due to abrasion as well as damage due to flexing of leg 40 and other members, is prevented by the engagement between contact pad 70 and leg 40.

Figure 2:
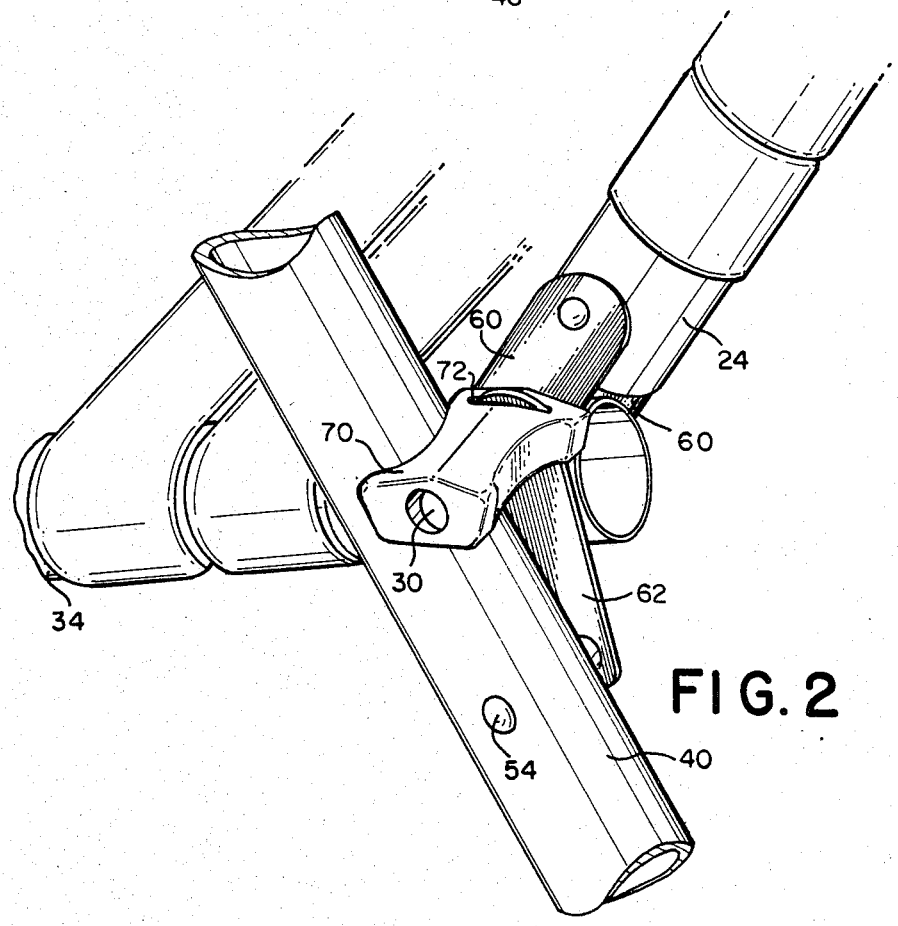
FIG. 2 is a partial enlarged perspective view of the chair of FIG. 1, showing details of the structure at the junction between the back and seat.

FIG. 2 shows a detailed view of the engagement between contact pad 70 and leg 40, and also the seat and back frames 34, 24. A swing strap 62 is pivotally attached at pivot pin 54 to leg 40, and at spreader rod 30, which extends through a hole in swing strap 62. Spreader rod 30 also passes axially through contact pad 70.

Pad 70 is preferably made of nylon or soft plastic and is disposed on the end of stretcher rod 30. The external contour of pad 70, namely, concave or semi-circular, prevents any axial movement of rod 30 with respect to leg 40. The resilience of pad 70 minimizes impact between rod 30, normally a steel rod, and leg 40, normally a hollow sheet metal aluminum tube.

Slot 72 formed adjacent the inner-facing end of pad 70, encloses the upward end of swing strap 62, through which rod 30 passes. Slot 72 is wider on one side of pad 70 than on the other to accommodate the change in relative position of pad 70 and swing strap 62 which occurs when the chair is folded. In any event, pad 70 is held securely on the end of rod 30 by means of swing strap 62. Pad 70 need therefore only be bored, and no opposed bolt or counter-sunk connection is necessary to keep pad 70 in position.

Figure 3:
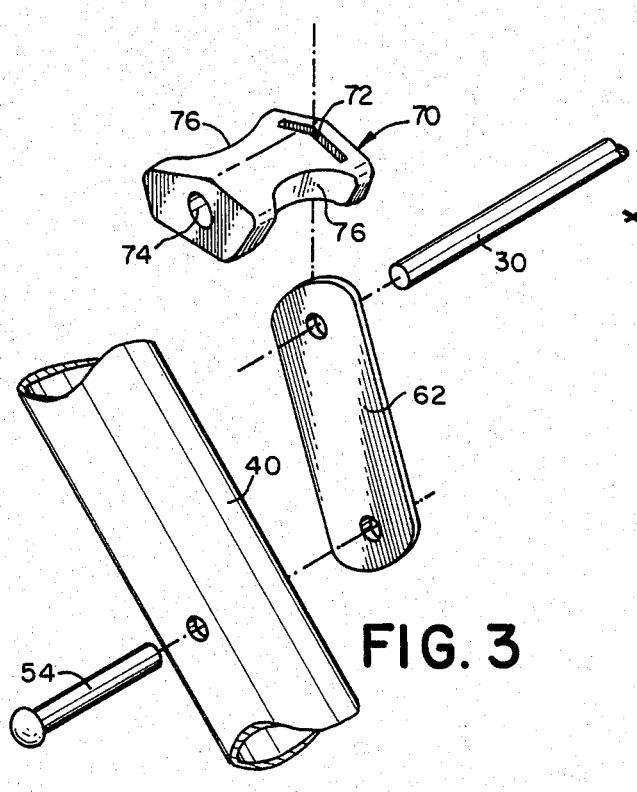
FIG. 3 is a partial exploded perspective view of the chair of FIG. 1, including elements shown in FIG. 2.

The connections are shown exploded in FIG. 3. Pad 70 is first placed over swing strap 62 such that bore 74 aligns with the upper hole in swing strap 62. Rod 30 is then placed through the upper hole and swing strap 62 is attached to leg 40 by means of pivot pin 54. This connection having been made, pad 70 is permanently attached. Pad 70 is formed in a symmetrical arrangement, having mirror image concave contact surfaces 76 on opposite sides. Accordingly, pad 70 may be installed on either the left or right end of spreader rod 30. It will be appreciated that inasmuch as slot 72 is wider on one side of pad 70 than the other, to accommodate changes in position during folding of the chair, pad 70 cannot be installed upside-down, but is merely interchangeable left to right, that is, on either end of rod 30. For square legs or legs of other cross section, surfaces 76 can be made square on otherwsie complementary to the legs.

Figure 4:
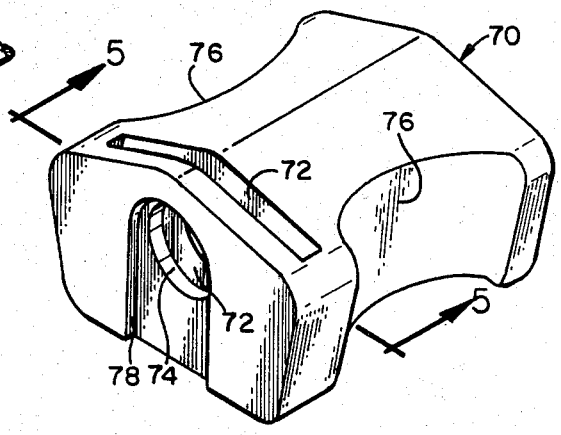
FIG. 4 is a perspective view of an alternative embodiment of the contact pad according to the invention.
Figure 5:
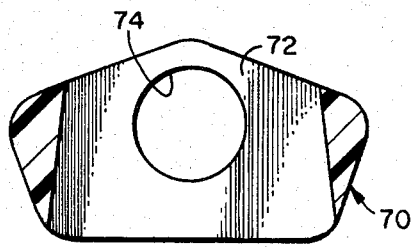
FIG. 5 is a section view taken along lines 5—5 in FIG. 4.

An alternative embodiment of the contact pad is shown in FIG. 4, and the pad is shown reversed as would be required for installation on the opposite end of rod 30. An indented area 78 is formed in the end of pad 70 closest to slot 72 and surrounding bore 74. Indentation 78 engages swing straps 60, which swing straps connect the back frame and the seat frame. As before, swing strap 62 is placed in slot 72, where spreader rod 30 locks the contact pad in position. FIG. 5 illustrates the variation in width of slot 72, required upon folding the chair.

Figure 6:
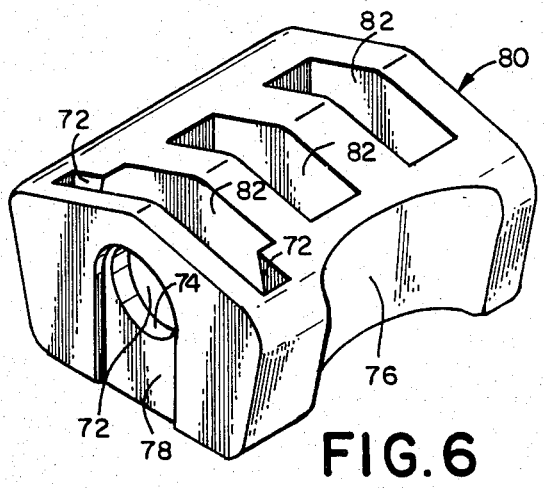
FIG. 6 is a perspective view of another alternative embodiment of the contact pad of the invention.

With reference to FIG. 6, the volume of plastic or other material required to make pad 70 may be reduced by including openings 82 at various portions of pad 76. As also shown in FIG. 6, the pad may be adapted to be flat on one side, and only formed with concavity 76 on the opposite side. Of course, in this embodiment, separate parts are required for installation on the left and right ends of rod 30.

Pad 70 provides a connection with is gentle, secure and convenient. No additional fasteners are required to permanently attach pad 70 to rod 30, as this is accomplished by slot 72 engaging swing strap 62. This engagement further aligns pad 70 to the required angle such that the concave bearing surfaces are aligned against leg 40, as further assisted by the indentation area 78, which engages swing strap 60. The overall effect is to substantially improve the mechanical connection between rod 30 and leg 40, preventing abrasion and also locking the chair against flexing when a user's weight is placed upon seat frame 34.

The resilient pad material intervening between rod 30 and leg 40 prevents damage due to impact between them. The concave contour of pad 70, complementing the external dimensions of leg 40 holds rod 30 against axial movement (i.e., movement perpendicular to the axis of leg 40). The chair does not flex. The user is more comfortable and secure; the chair's life is substantially increased.

The invention having been disclosed, a number of variations will now become apparent to persons skilled in the art. Reference should be made to the appended claims rather than the foregoing specification as indicating the true scope of the invention.

What is claimed is:

1. A foldable chair, comprising:

a back frame and a seat frame, hingeably attached to a spreader rod, the spreader rod having ends protruding past the back frame and the seat frame;

a front leg member and a rear leg member, carrying the back frame and the seat frame, the spreader rod also extending past at least one of the front leg member and the rear leg member, the spreader rod bearing transversely against said one of the front and rear leg members when the chair is unfolded; and, a contact pad mounted on each protruding end of the spreader rod and axially-fixed to the spreader rod, the contact pad being an externally contoured bushing, axially bored to fit over the spreader rod and having an external face shaped to engage said one of the leg members, the contact pad fixing the spreader rod against axial movement thereof over said at least one of the leg members, whereby the chair is secure when unfolded and said at least one of the leg members is protected from wear due to contact with the spreader rod.

2. The chair of claim 1, wherein the contact pad has shaped external faces on two opposite sides, said external faces being shaped to engage said at least one of the leg members, whereby the contact pad is interchangeably fittable on either end of the spreader rod.

3. The chair of claim 2, wherein the contact pad is molded plastic.

4. The chair of claim 2, wherein the contact pad is nylon.

5. The chair of claim 1, wherein the contact pad is indented on an end thereof facing inward along the spreader rod toward said back frame and seat frame, the indented end engaging a further swing strap pivotally attaching the seat frame and back frame.

6. The chair of claim 1, wherein the seat frame and back frame are tubular "U" bodies pivotally joined at legs of said "U" bodies, the spreader rod passing through the legs of the "U" bodies of the seat frame on opposite sides of the chair, the legs of the "U" bodies of the back frame being pivotally connected to the legs of the "U" bodies of the seat frame by two pair of swing straps disposed on opposite sides of the back frame, on both sides of the chair, each pair of swing straps pivotally engaging the spreader rod on opposite sides of the seat frame, the seat frame and back frame being hingeable on the spreader rod, and the spreader rod bearing transversely against said at least one of the leg members.

7. The chair of claim 6, further comprising a leg swing strap for each side of the chair, the leg swing strap pivotally connecting the leg member and the spreader rod, the contact pad being mounted toward the end of the spreader rod from the leg swing strap.

8. The chair of claim 6, wherein the contact pad is indented on an end facing the back frame, the leg swing strap being engaged by said indented end.

9. In a foldable chair having supporting leg members and a spreader rod having ends extending across said leg members and swing straps pivotably connecting the leg members to the spreader rods at a point spaced from opposite ends of the spreader rod such that upon unfolding the chair, the ends of the spreader rod bear transversely against the leg members, the improvement comprising:

a contact pad adapted to fit over said ends of the spreader rod, the contact pad having an external contour shaped to engage the leg member, the contact pad also having a slot for engaging the swing strap, the contact pad protecting the leg member from direct contact with the spreader rod and fixing the spreader rod against movement along its axis, transversely over the leg member.

* * * * *

UNITED STATES PATENT AND TRADEMARK OFFICE

CERTIFICATE OF CORRECTION

PATENT NO. : 4,536,026

DATED : August 20, 1985

INVENTOR(S) : Howell Cornell

It is certified that error appears in the above-identified patent and that said Letters Patent is hereby corrected as shown below:

In Claim 1, Line 59, after the semi-colon (;) add --a swing strap pivotally connecting opposite ends of the spreader rod to at least one of said frames and leg members;-- in Line 62 after "rod", "and" has been deleted and the following added --, the contact pad having a transverse slot for receiving the swing strap such that the contact pad is--.

Signed and Sealed this

Ninth Day of January, 1990

*Attest:*

JEFFREY M. SAMUELS

*Attesting Officer*

*Acting Commissioner of Patents and Trademarks*